US007315701B2

(12) United States Patent
Soures et al.

(10) Patent No.: US 7,315,701 B2
(45) Date of Patent: Jan. 1, 2008

(54) SYSTEMS AND METHODS FOR REDUCING TRANSFER DELETIONS IN AN ELECTROSTATOGRAPHIC PRINTER

(75) Inventors: Michael Nicholas Soures, Webster, NY (US); Robert Arnold Gross, Penfield, NY (US); David Kenneth Ahl, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 160 days.

(21) Appl. No.: 11/268,377

(22) Filed: Nov. 7, 2005

(65) Prior Publication Data

US 2007/0104519 A1 May 10, 2007

(51) Int. Cl.
*G03G 15/00* (2006.01)

(52) U.S. Cl. ..... 399/16; 399/45; 399/394; 399/396

(58) Field of Classification Search ..... 399/16, 399/45, 301, 316, 317, 388, 389, 395, 396, 399/394
See application file for complete search history.

(56) References Cited

U.S. PATENT DOCUMENTS 2,836,725 A 5/1958 Vyverberg
5,613,179 A 3/1997 Carter et al.
5,923,921 A 7/1999 OuYang et al.
6,188,863 B1 * 2/2001 Gross et al. ..... 399/316
6,327,445 B1 12/2001 Honda et al.
6,510,296 B2 1/2003 Less et al.
2004/0086289 A1 * 5/2004 Deguchi ..... 399/45

* cited by examiner

*Primary Examiner*—Hoang Ngo
(74) *Attorney, Agent, or Firm*—Maginot, Moore & Beck

(57) ABSTRACT

An apparatus is provided for reducing transfer deletions in an electrostatographic machine. The apparatus includes a registration controller for driving a print substrate at a registration velocity and feeding the print substrate to an image-retentive member. The apparatus also includes a system controller operably associated with the registration mechanism controller. The system controller monitors at least one operating parameter of an image forming apparatus and generates a control signal in response to the monitored operating parameter(s). The registration controller is responsive to the control signal and is configured to adjust the registration velocity in accordance with the control signal as the image-retentive member is driven at a preselected velocity. The apparatus further includes a transfer assist mechanism movably mounted adjacent a photoreceptive member so the transfer assist mechanism may be moved from a non-operative position to an operative position to provide substantially uniform contact between the print substrate and the image-retentive member.

20 Claims, 5 Drawing Sheets

SYSTEMS AND METHODS FOR REDUCING TRANSFER DELETIONS IN AN ELECTROSTATOGRAPHIC PRINTER

TECHNICAL FIELD

The present disclosure relates generally to an electrostatographic printing system, and, more specifically, concerns an apparatus and method for reducing transfer deletions in an electrostatographic machine during the transfer of a toned image from an imaged surface to a print substrate.

BACKGROUND

In high-speed reproduction machines, such as electrostatographic copiers and printers, a photoconductive member (or photoreceptor) is charged to a uniform potential and then a light image of an original document is exposed onto a photoconductive surface, either directly or via a digital image driven laser. Exposing the charged photoreceptor to a light image discharges the photoconductive surface thereof in areas corresponding to non-image areas in the original document while maintaining the charge on the image areas to create an electrostatic latent image of the original document on the photoconductive surface of the photoreceptor. A developer material is then brought into contact with the surface of the photoconductive member to transform the latent image into a visible reproduction. The developer material includes toner particles with an electrical polarity opposite that of the photoconductive member, causing them to be naturally drawn to it. A blank print substrate such as a sheet of paper is brought into contact with the photoconductive member and the toner materials are transferred to it by electrostatic charging of the substrate. The substrate is subsequently heated and pressed to permanently bond the reproduced image to the substrate, thus producing a hard print reproduction of the original document or image. Thereafter, the photoconductive member is cleaned and reused for subsequent print production.

Various sizes of print substrates are typically stored in trays that are mounted at the side of the machine. In order to duplicate a document, a print substrate with the appropriate dimensions is transported from the appropriate tray into the paper path just ahead of the photoreceptor. The substrate is then brought into contact with the toner image on the surface of the photoconductive member prior to transfer. However, a registration mechanism typically intercepts the substrate in advance of the photoconductive member and either stops it or slows it down in order to synchronize the substrate with the image on the photoconductive member. The registration mechanism also effects proper process direction (or longitudinal) alignment of the print substrate prior to delivery to the photoconductive member by correcting skew in the substrate. The registration mechanism also effects proper cross-process direction (or lateral) alignment of the print substrate prior to delivery to the photoconductive member by correcting lateral offset in the substrate.

The process of transferring charged toner particles from an image bearing member, such as the photoreceptive member, to an image support substrate, such as a print sheet, is accomplished at a transfer station. In a conventional electrostatographic machine, transfer is achieved by transporting an image support substrate into the area of the transfer station where electrostatic force fields sufficient to overcome the forces holding the toner particles to the photoconductive surface are applied to the substrate to attract and transfer the toner particles to the image support substrate. In general, such electrostatic force fields are generated via electrostatic induction using a corona generating device. The reverse side of the print sheet is exposed to a corona discharge while the front of the print sheet is placed in direct contact with the developed toner image on the photoconductive surface. The corona discharge generates ions having a polarity opposite that of the toner particles, thereby electrostatically attracting and transferring the toner particles from the photoreceptive image bearing member to the print sheet. An exemplary corotron ion emission transfer system is disclosed in U.S. Pat. No. 2,836,725.

Unfortunately, the interface between the image bearing surface and the print sheet is not always optimal. Particularly, with non-flat print sheets, such as print sheets that have already passed through a fixing operation (e.g., heat and/or pressure fusing), perforated sheets, or sheets that are brought into imperfect contact with the charge retentive surface, the contact between the sheet and the image bearing surface may be non-uniform, being characterized by gaps where physical contact fails. The toner particles tend not to transfer across these gaps, causing a print quality defect referred to as transfer deletion.

As described, the process of transferring development materials in an electrostatographic system involves the physical detachment and transfer of charged toner particles from an image bearing surface to a substrate via electrostatic force fields. In addition, other forces, such as mechanical pressure or vibratory energy, have been used to enhance the transfer process. The critical aspect of the transfer process focuses on applying and maintaining high intensity electrostatic fields as well as other forces in the transfer region to overcome the adhesive forces acting on the toner particles. Careful control of these electrostatic fields and other forces is required to induce the physical detachment and transfer of the charged toner particles without scattering or smearing the developer material.

The problem of transfer deletion has been addressed by various approaches. For example, mechanical devices that force the substrate into intimate and complete contact with the image bearing surface have been incorporated into transfer systems. Using this approach, blade arrangements have been proposed for sweeping over the back side of the substrate at the entrance to the transfer region. Alternatively, acoustic agitation or the use of vibratory energy has been disclosed as a method for enhancing toner release from the image bearing surface. Generally, systems using these methods also incorporate a resonator for generating vibratory energy, which is applied to the back of image bearing surface. Toner is thereby released from the image bearing surface despite the fact that the electrostatic charges in the transfer zone may be insufficient to attract toner from the image bearing surface to the substrate. These vibratory methods are not always effective. Therefore, other methods for improving the efficiency of transferring toner to the print substrate would be useful.

SUMMARY

An apparatus is disclosed herein for improving toner particle transfer and for reducing transfer deletions in an electrostatographic machine. The apparatus comprises a registration mechanism controller for driving a registration mechanism in the process direction. The apparatus also includes a system controller operably associated with the registration mechanism controller. The system controller monitors at least one operating parameter of an image forming apparatus and generates a control signal in response to the monitored operating parameter. The registration mechanism controller is responsive to the control signal and drives the registration mechanism at a velocity that corresponds to the control signal. The apparatus further includes a transfer assist mechanism movably mounted adjacent a photoreceptive member so the transfer assist mechanism may be moved from a non-operative position to an operative position to provide substantially uniform contact between a print substrate supplied from said registration mechanism and the photoreceptive member.

In an alternative embodiment, the operating parameter that is monitored may comprise print substrate type. When the print substrate type is determined to be a lightweight media, the system controller is operable to generate a reduce velocity control signal for the registration mechanism controller. In response to the reduce velocity control signal, the registration mechanism controller is operable to reduce the velocity of the registration mechanism a predetermined amount relative to a preselected velocity of the photoreceptor belt.

In yet another embodiment, the transfer assist mechanism includes at least one blade portion for applying pressure against the print substrate in a direction toward said photoreceptive member, each of said at least one blade portion including a contact surface, a leading edge and a trailing edge, said contact surface comprising a convex middle portion relative to said leading and trailing edges of said contract surface, said convex middle portion extending approximately the width of said contact surface in the cross-process direction.

The systems described herein enable a method to be performed that facilitates the reducing of transfer deletions in an electrostatographic machine. The method comprises registering and feeding a print substrate to a photoreceptive member at a registration velocity corresponding to a preselected velocity of said photoreceptive member; providing substantially uniform contact between said print substrate and said photoreceptive member using a transfer assist mechanism; monitoring at least one operating parameter of an electrostatographic machine; generating a control signal in response to the at least one operating parameter; and adjusting the registration velocity in response to said control signal. The monitored operating parameter of the electrostatographic machine may comprise print substrate type. Thus, the method may further comprise generating a reduce velocity control signal when the monitored print substrate type is a lightweight media.

The systems and method, described in more detail below, operate to reduce transfer deletions by putting the print substrate in tension during the transfer process. This reduces the tendency of a print substrate to wrinkle during transfer and reduces or prevents transfer deletions. Other benefits and advantages of the systems and methods for reducing transfer deletions in an electrostatographic machine will become apparent upon reading and understanding the following drawings and specification.

BRIEF DESCRIPTION OF THE DRAWINGS

Aspects and features of the present embodiments will become apparent as the following description proceeds and upon reference to the drawings, in which.

DESCRIPTION

Figure 1:
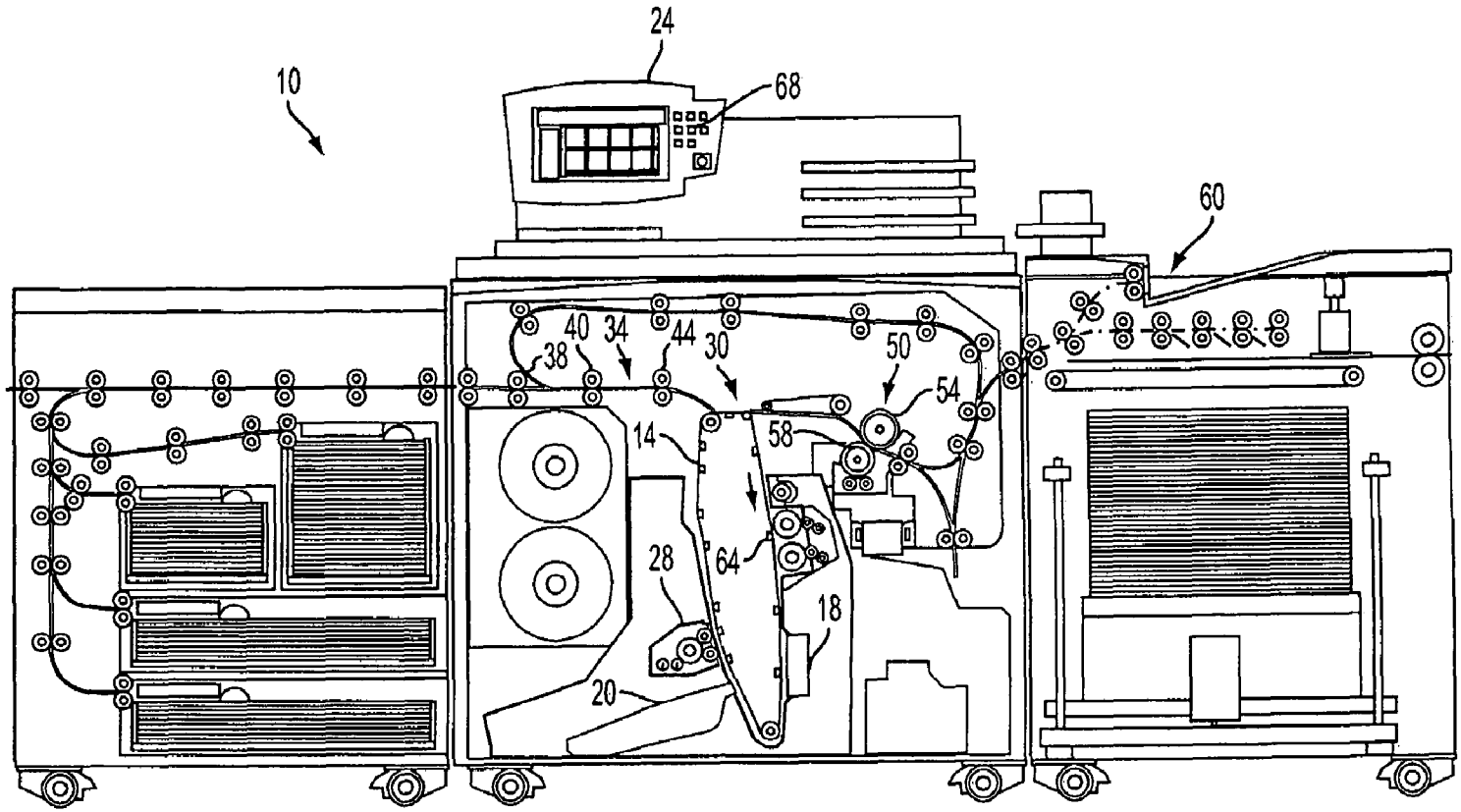
FIG. 1 is a schematic elevational view of an illustrative electrostatographic machine.

For a general understanding of the present embodiments, reference is made to the drawings. In the drawings, like reference numerals have been used throughout to designate like elements.

An exemplary imaging system comprises a multifunctional printer with print, print, scan, and fax services. Such multifunctional printers are well known in the art and may comprise print engines based upon liquid or solid ink jet, electrophotography, other electrostatographic technologies, and other imaging technologies.

Moving now to a description of FIG. 1, the exemplary electrostatographic machine 10 employs an image-retentive member, such as photoreceptor belt 14. The belt 14 includes a photoconductive surface deposited on an electrically grounded conductive substrate. Photoreceptor 14 continuously travels the circuit depicted in the figure in the direction indicated by the arrow advancing successive portions of the photoconductive surface of the belt 14 through various processing stations, disposed about the path of movement thereof, as will be described. While a photoreceptor belt 14 is shown, it is to be understood that other types of image-retentive members could be used, such as an intermediate belt or drum used in a color electrophotographic machine, offset printing apparatus, or ink-jet printer.

Initially, a segment of belt 14 passes through charging station 18. At charging station A, a corona generating device (not shown) or other charging apparatus, charges photoreceptor belt 14 to a relatively high, substantially uniform potential. Once charged, the photoreceptor belt 14 is advanced to imaging station 20.

At imaging station 20, a raster output scanner (ROS) (not shown) discharges selectively those portions of the charge corresponding to the image portions of the document to be reproduced. In this way, an electrostatic latent image is recorded on the photoconductive surface. An electronic subsystem (ESS) (not shown) controls the ROS. The ESS is adapted to receive signals from a system controller 24 and transpose these signals into suitable signals for controlling the ROS so as to record an electrostatic latent image corresponding to the document to be reproduced by the printing machine 10. Other types of imaging systems may also be used employing, for example, a pivoting or shiftable LED write bar or projection LCD (liquid crystal display) or other electro-optic display as the "write" source.

After the electrostatic latent image is recorded on photoconductive surface of belt 14, belt 14 advances to development station 28 where toner material is deposited onto the electrostatic latent image. In the development station 28, toner particles are mixed with carrier beads, generating an electrostatic charge therebetween which causes the toner particles to cling to the carrier beads to form developing material. The developing material is brought into contact with the photoreceptor belt 14 such that the latent image thereon attracts the toner particles from the developing material to develop the latent image into a visible image.

After the toner particles have been deposited onto the electrostatic latent image for creating a toner image thereof, belt 14 becomes an image bearing support surface for advancing the developed image to transfer station 30. At transfer station 30, a print substrate 68 is moved into contact with the developed toner image via registration subsystem 34. The interface between the registration subsystem 34 and transfer station 30 includes an apparatus for applying uniform contact pressure to the sheet as it is advanced onto belt 14 (described in more detail below).

A print substrate 68 is advanced by registration subsystem 34 from an upstream supply, such as from an upstream feeder or a duplex path, by at least one roll pair, such as exemplary roll pairs 38, 40, 44 and 48 shown. The registration subsystem 34 laterally registers and deskews substrate 68 before the substrate 68 contacts the photoconductive surface of belt 14.

Each roll pair consists of a drive roll backed by an opposing hard idler roll that define a nip region therebetween. While only single roll pairs are shown in the side view, there are preferably two roll pairs at each location, one outboard and one inboard in the width direction of the substrate 68 (cross process direction). The drive rolls are driven by a drive mechanism (not shown), such as a drive motor operably coupled to the roll. Suitable coupling may be through a drive belt, pulley, output shaft, gear or other conventional linkage or coupling mechanism. The position, timing and velocity of the substrate are controlled by registration controller 204 (See FIG. 2) which receives signals from the system controller 24.

Figure 2:
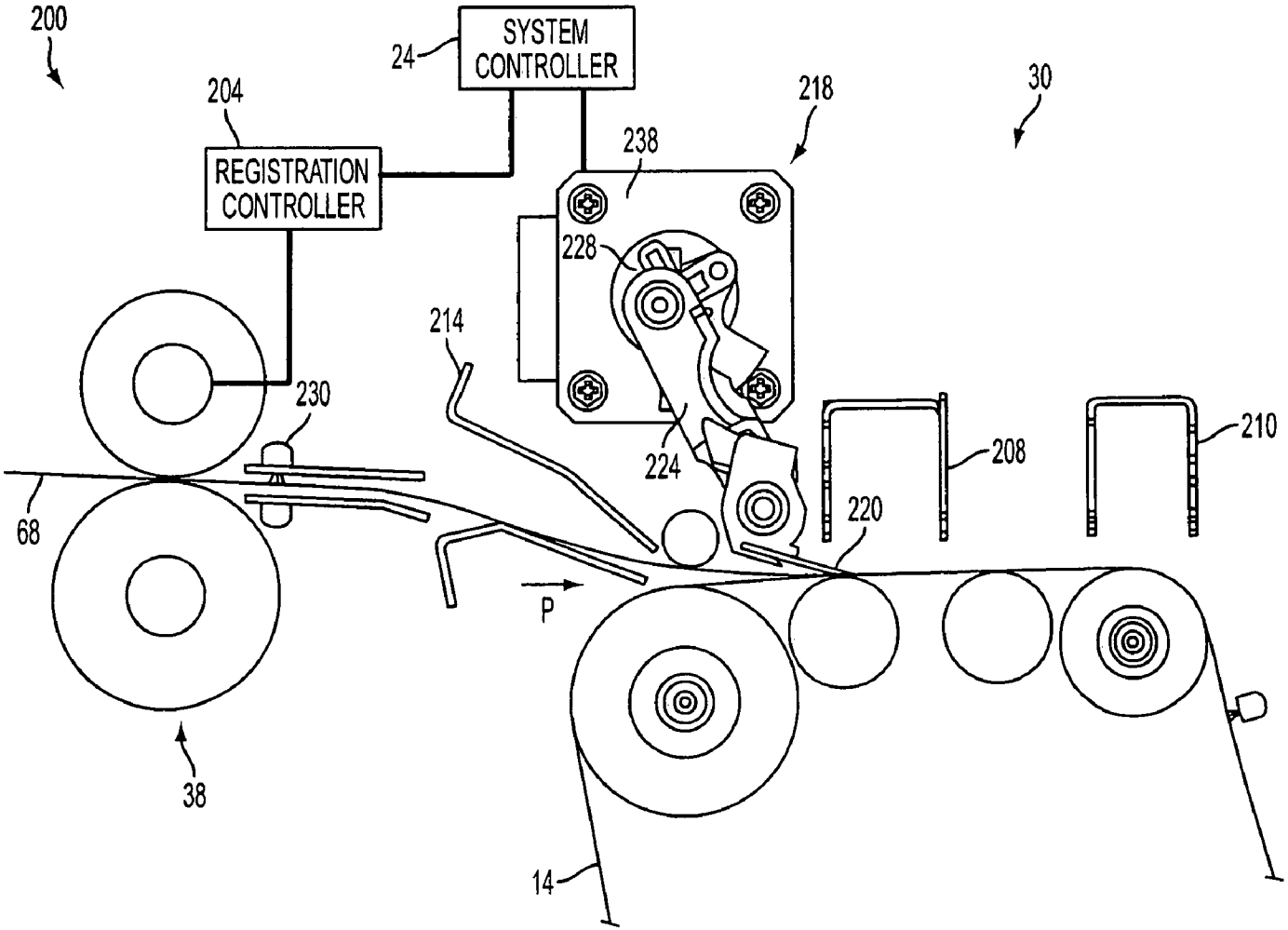
FIG. 2 is a schematic elevational view of an apparatus for reducing transfer deletions in the electrostatographic machine of FIG. 1.

With reference to FIG. 2, at transfer station 30, a corona generating device 208 charges the print sheet to the proper magnitude and polarity in order to establish a transfer field that is effective to tack the print sheet 68 to photoconductive belt 14 and to attract the developed image from the photoconductive belt 14 to the print sheet 68. Thereafter, the print sheet moves with photoconductive belt 14, in the direction of arrow P.

After transfer, a corona generator 210 charges the print sheet 68 with an opposite polarity to detack the print sheet 68, whereupon the sheet 68 is stripped from belt 14. The support substrate may also be an intermediate surface or member, which carries the toner image to a subsequent transfer station for transfer to a final support surface. These types of surfaces are also charge retentive in nature. The substrate 68 is subsequently separated from the belt 10 and transported to a fusing station 50 (See FIG. 1). The toner image is thereby forced into contact with the substrate 68 between fuser rollers 54 and 58 to permanently affix the toner image to substrate 68. After fusing, the print substrate 68 is advanced to receiving tray 60 for subsequent removal by an operator.

Invariably, after the print substrate 68 is separated from belt 14, some residual developing material remains adhered to the photoconductive surface of the belt 14. Thus, a final processing station, namely, cleaning station 64, is provided for removing residual toner particles from photoreceptor belt 14.

The various machine functions are regulated by a system controller 24 having a user interface 68. The controller 24 is preferably a programmable microprocessor which controls all of the machine functions hereinbefore described. The controller may be programmed to monitor various operating parameters of the electrostatographic machine such as print substrate type, the number of documents being recirculated, the number of print sheets selected by the operator, time delays, and jam indications, among other various functions including transfer assist actuation. Conventional sheet path sensors or switches may be utilized to keep track of the types and position of documents and print substrates in the machine. The operation of all of the exemplary systems described hereinabove may be accomplished by conventional user interface control.

The foregoing description should be sufficient for purposes of illustrating the general operation of an electrostatographic printing machine incorporating an exemplary embodiment of an apparatus for reducing transfer deletions. As described, an electrostatographic printing machine may take the form of any of several well known devices or systems. Variations of specific electrostatographic processing subsystems or processes may be expected without affecting the operation of the exemplary embodiment.

Referring now to FIG. 2, there is shown a schematic for an apparatus 200 for reducing transfer deletions between a print substrate and an image-retentive member in an electrostatographic machine. The apparatus 200 comprises a registration controller 204 for driving a print substrate 68 in the process direction P. The apparatus also includes a system controller 24 operably associated with the registration controller 204. The system controller 24 monitors at least one operating parameter of an electrostatographic machine and generates a control signal in response to the monitored operating parameter. The registration controller 204 is responsive to the control signal and drives the print substrate 68 at a velocity that corresponds to the control signal. The apparatus 200 further includes a transfer assist mechanism 218 arranged adjacent to the photoreceptive member 14 for providing substantially uniform contact between a print substrate 68 and the photoreceptive member 14.

Referring again to FIG. 2, the registration controller 204 drives the print substrate 68 by controlling at least one pair of registration drive rollers 38. The registration drive rollers 38 are driven in the process direction P by a drive mechanism (not shown), such as a drive motor operably coupled to the roll. In the exemplary embodiment, the motor is a stepper motor. However, other types of motors may be used. The drive mechanism is controlled by the registration controller 204. In the case of an exemplary stepper motor, controller 204 provides instructions to the motor in the form of stepper motor counts instructing the motor how many turns (or steps) to advance. Registration controller 204 may be a microprocessor or can derive its processing power from system controller 24. Additionally, registration controller 204 can include RAM, ROM, and I/O devices for interfacing with drive mechanism and drive rollers 38.

The registration controller 204 is, in turn, controlled by the system controller 24. The system controller 24 generates control signals for the registration controller 204 that are based on monitored operating parameters such as print substrate type. Subsequently, the registration controller 204 drives the print substrate 68 at a velocity that corresponds to these control signals. Generally, the control signal indicates that the print substrate 68 should be driven at a velocity that approximates the preselected velocity of the image-retentive member 14. However, when the system controller 24 has determined that the print substrate type to be used is a lightweight media, the system controller 24 generates a reduce velocity control signal for the registration controller 204. In response, the registration controller 204 drives the registration drive rollers 38 slower than the photoreceptor belt 14 thereby putting the print substrate 68 in tension. This reduces the tendency of a print substrate 68 to wrinkle during transfer and reduces or prevents transfer deletions. In one embodiment, the registration controller 204 reduces the velocity of the registration drive rollers 38 by approximately 2-3% in response to the control signal indicating that a lightweight media is being used.

Referring to FIG. 2, at transfer station 30, the print substrate 68 is moved into contact with the developed toner image via registration system 34 and chute 214 for placing the substrate 68 into synchronous contact with the developed toner image. The position of chute 214 with reference to registration subsystem 34 may be moved to accommodate different delivery aspects for media to the photoreceptor belt 14.

Referring again to FIG. 2, there is a shown a transfer assist mechanism 218 for providing substantially uniform contact between the print substrate 68 and the photoreceptor belt 14 after the substrate 68 is moved into contact with the developed toner image. The transfer assist mechanism 218 includes a transfer assist blade 220 that presses the print substrate 68 into intimate contact with the toner on the image area of the belt 14. The transfer assist blade 220 is beneficially comprised of an approximately 3 to 5 mil thickness of a non-conductive material. The blade 220 is removably secured to a rotatable member 224.

In use, a light sensor 230 detects the leading edge of the print sheet as it enters transfer station D and the signal from the light sensor is processed by a circuit for controlling the actuation of the blade 220 which is moved from a non-operative position, spaced from the print sheet and photoconductive belt 14, to an operative position in contact with the backside of the print sheet 68. The rotatable member 224 moves blade 220 between the operative and non-operative positions. In the operative position, blade 220 presses the print sheet into contact with the toner powder image developed on photoconductive belt 14 for substantially eliminating any spaces between the print sheet 68 and the toner powder image such that the continuous pressing of the sheet into contact with the toner powder image at the transfer station insures that the print sheet is in substantially intimate contact with the belt 14.

As the trailing edge of the print sheet passes the light sensor, the light sensor transmits a signal to a processing circuit which actuates rotatable member 224 for shifting the blade 220 to its non-operative position. In the non-operative position, blade 220 is spaced from the print sheet and the photoconductive belt, insuring that blade 220 does not scratch the photoconductive belt or accumulate toner particles thereon which may be deposited on the backside of the next successive print sheet.

In a typical embodiment, activation and deactivation of transfer assist blade 220 is induced by rotation of cam 228 which acts upon rotatable member 224. The system controller 24 determines the timing for activating a stepper motor 238 that controls the rotation of cam 228 in order that the transfer assist blade 220 is in contact with the back of print substrate 68 as near as possible to both the leading and the trailing edges of the substrate 68.

Figure 3:
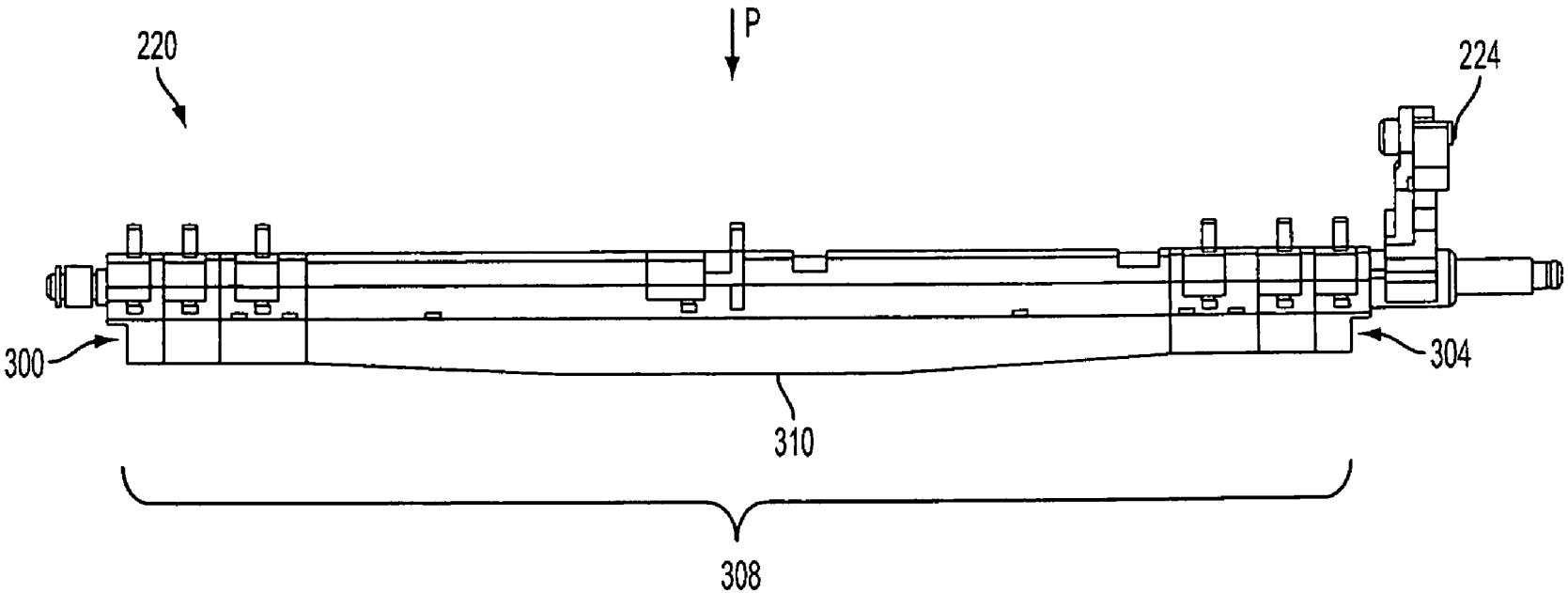
FIG. 3 is an enlarged side elevational view of the transfer assist blade of FIG. 2.

With reference to FIG. 3, the transfer assist blade 220 includes a first end 300, a second end 304 and a contact edge 308. The contact edge 308 presses the substrate 68 into intimate contact with the photoreceptor belt. The contact edge 308 has a convex middle portion 310 relative to the first and second ends 300, 304 of the contact edge 308. The convex middle portion 310 causes a higher pressure load between the print substrate 68 (not shown) and the photoreceptor belt 14 (not shown) in the middle of the blade 220. In one embodiment, the convexity of the middle portion 310 extends approximately entirely from first end to second end in the cross-process direction. This limits possible defects that can result from discontinuity of transfer assist blade 220 force in localized transitions between blades in cases where multiple transfer assist blades are used. As shown in FIG. 2, The transfer assist blade 220 is positioned adjacent the transfer field formed by the corona generating device 208 thereby limiting the extension of the transfer assist blade 220 into the transfer field. This reduces defects that can result from higher substrate fields in localized places in the transfer field during transfer.

Figure 4:
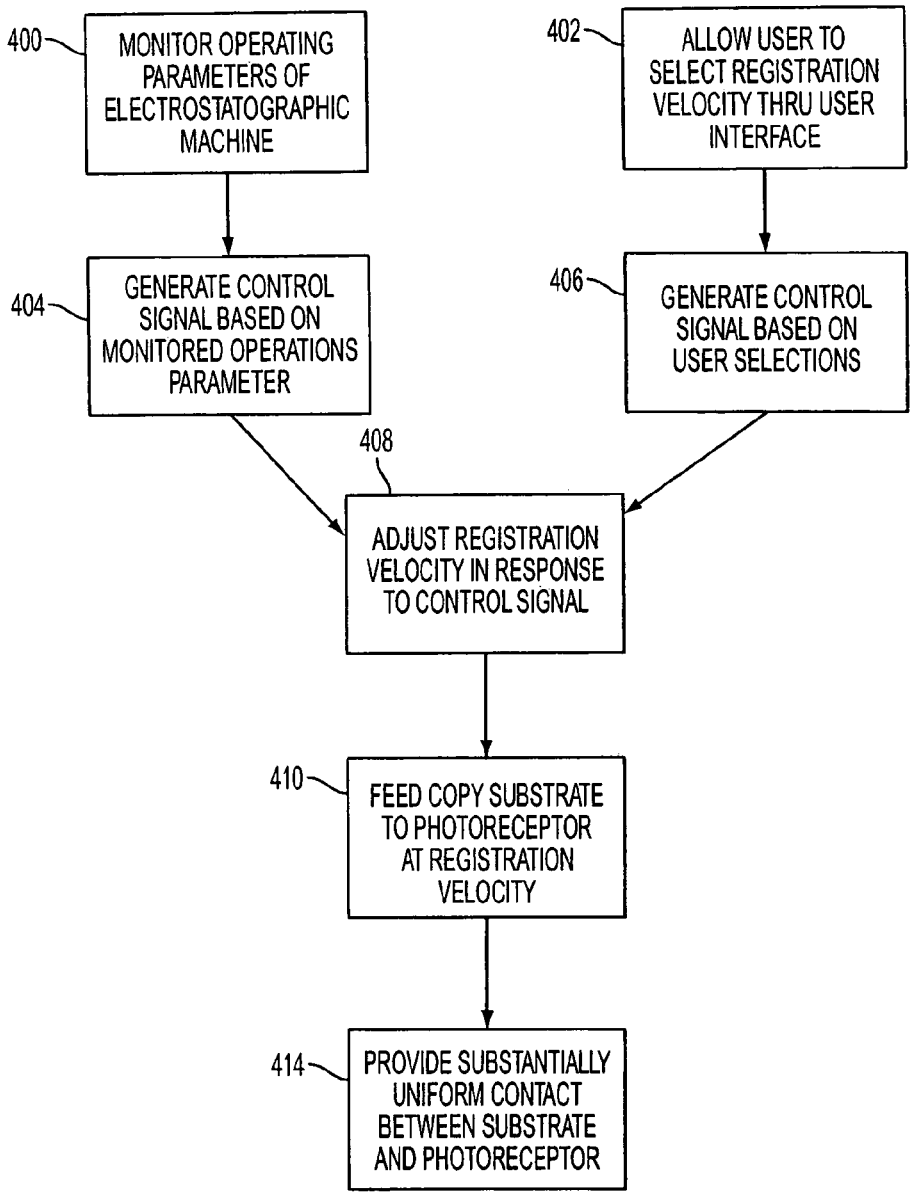
FIG. 4 is a flowchart of an exemplary method for reducing transfer deletions in the electrostatographic machine of FIG. 1.

FIG. 4 is a flowchart outlining an exemplary embodiment of a method for reducing transfer deletions in an electrostatographic machine. The method comprises monitoring at least one operating parameter of an electrostatographic machine (block 400). A control signal is generated that is based on the at least one monitored operating parameter (block 404). In response to the control signal, the registration velocity is adjusted relative to a preselected velocity of a photoreceptive member (block 408). Subsequently, a print substrate is fed to the photoreceptive member at the registration velocity (block 410). While the substrate is being fed to the photoreceptive member, substantially uniform contact between the print substrate and the photoreceptive member is maintained using a transfer assist mechanism (block 414).

The method may further comprise allowing a user to select a velocity for the registration mechanism (block 402). A velocity control signal is then generated that corresponds to the selections made by the user (block 406). This can be accomplished by providing a user interface that is operably associated with the system controller. The user interface may provide user selectable options that include the option to select a registration velocity.

Figure 5:
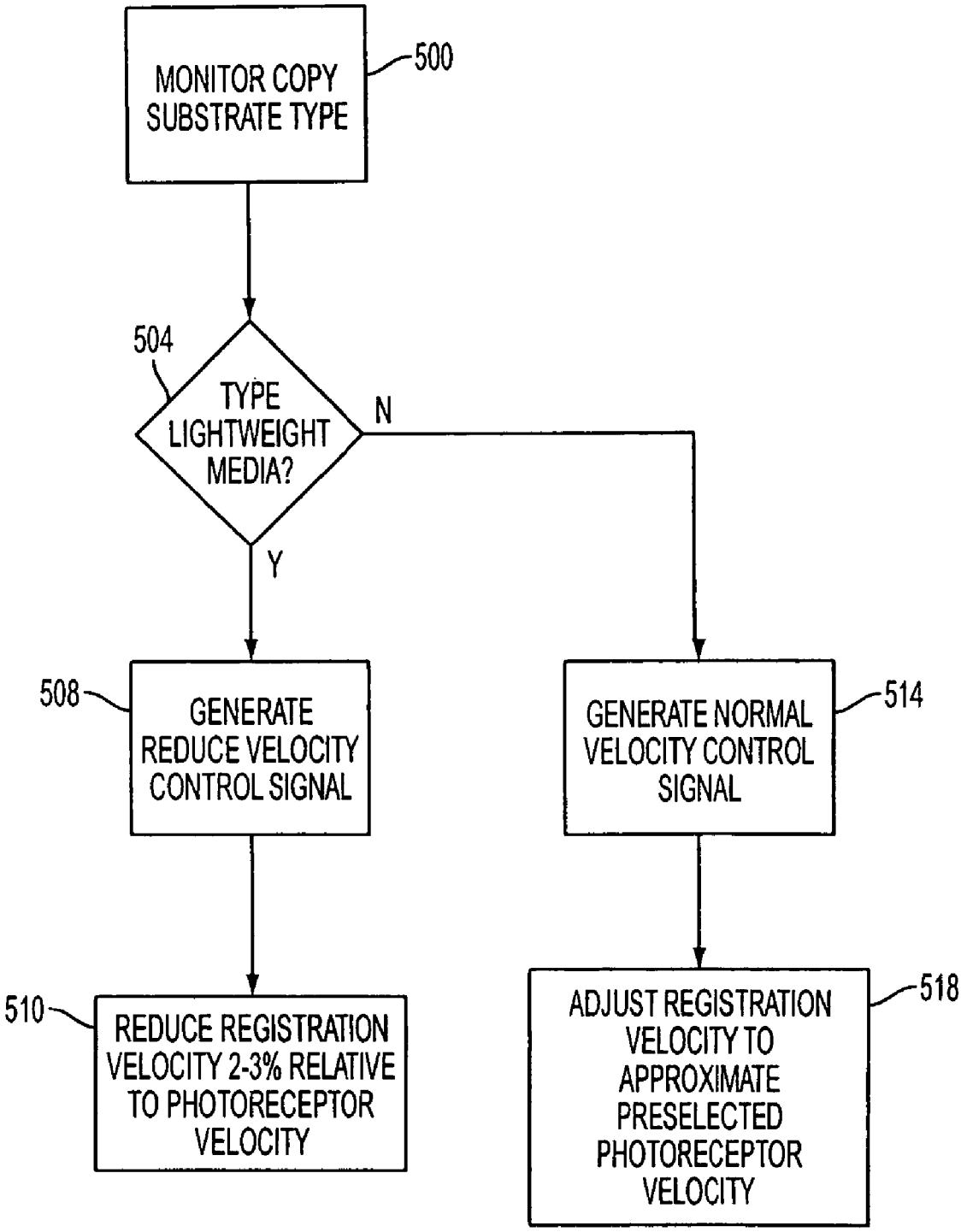
FIG. 5 is a flowchart of an alternative embodiment of the method of FIG. 4.

Referring to FIG. 5, the exemplary embodiment of the method may further comprise monitoring print substrate type (block 500). In this embodiment, the system controller generates a signal based on the type of substrate detected (block 504). When the substrate type is determined to be a lightweight media, a reduce velocity control signal is generated (block 508). In response to the reduce velocity control signal, the velocity of the registration mechanism is reduced relative to a preselected velocity of said photoreceptive member. The velocity of the registration mechanism may be reduced approximately 2-3% relative to the preselected velocity of the photoreceptive member (block 510). If the substrate type is determined to not be a lightweight media, the system controller generates a normal velocity control signal (block 514). The normal velocity control signal indicates that the velocity of the registration mechanism should be adjusted to approximate the velocity of the preselected velocity of the photoreceptive member (block 518).

In another embodiment of the method, a transfer assist mechanism is provided including at least one blade portion for applying pressure against the print substrate in a direction toward the photoreceptive member. The blade portion includes a contact surface, a leading edge and a trailing edge. The contact surface comprises an elevated middle portion relative to the leading and trailing edges of the contract surface. The raised middle portion extends approximately the width of the contact surface. Preferably, the contact surface is essentially convex from the leading edge to the trailing edge.

While various exemplary embodiments have been described and illustrated, it is to be understood that many alternatives, modifications and variations would be apparent to those skilled in the art. Accordingly, Applicants intend to embrace all such alternatives, modifications and variations that follow in the spirit and scope of this disclosure.

What is claimed is:

1. An apparatus for reducing transfer deletions in an electrostatographic machine, the apparatus comprising:

a registration controller for driving a print substrate at a registration velocity and feeding said print substrate to an image-retentive member;

a system controller operably associated with said registration controller, said system controller for monitoring at least one operating parameter of an electrostatic machine and generating a control signal in response to the at least one operating parameter;

the registration controller being responsive to said control signal and is configured to adjust the registration velocity in accordance with said control signal as the image-retentive member is driven at a preselected velocity; and a transfer assist member movably mounted adjacent the image-retentive member so that the transfer assist member may be moved from a non-operative position to an operative position to provide substantially uniform contact between the print substrate and the image-retentive member.

2. The apparatus of claim 1, the at least one operating parameter monitored by the system controller comprises print substrate type.

3. The apparatus of claim 2, the system controller is operable to generate a reduce velocity control signal in response to said print substrate type being lightweight media.

4. The apparatus of claim 3, wherein the registration controller being operable to reduce the registration velocity of said print substrate by a predetermined value relative to the preselected velocity of the image-retentive member in response to said reduce velocity control signal.

5. The apparatus of claim 4, the predetermined value being approximately 2-3%.

6. The apparatus of claim 5, said transfer assist member includes at least one blade portion for applying pressure against the print substrate in a direction toward said photoreceptive member, each of said at least one blade portion including a contact surface, a leading edge and a trailing edge, said contact surface comprising a convex middle portion relative to said leading and trailing edges of said contract surface, and said convex middle portion extending approximately across a width of said contact surface in a cross-process direction.

7. The apparatus of claim 6, said contact surface being essentially convex from said leading edge to said trailing edge.

8. The apparatus of claim 1, said system controller being operably associated with a user interface, said user interface being configured to allow selection of the registration velocity; and said system controller generates a velocity control signal corresponding to selections made by a user through said user interface.

9. A method for reducing deletions in an electrostatographic machine, the method comprising:

driving a photoreceptive member at a preselected velocity;

monitoring at least one operating parameter of an electrostatographic machine;

generating a control signal based on the at least one monitored operating parameter;

adjusting a registration velocity relative to the preselected velocity of the photoreceptive member in response to said control signal;

feeding a print substrate to the image-retentive member at the adjusted registration velocity as the photoreceptive member is driven at the preselected velocity; and providing substantially uniform contact between the print substrate and the image-retentive member using a transfer assist member.

10. The method of claim 9, the monitoring at least one operating parameter further comprises monitoring print substrate type.

11. The method of claim 10, the control signal generation further comprises generating a reduce velocity control signal in response to said print substrate type being lightweight media.

12. The method of claim 11, the registration velocity adjustment further comprises reducing the registration velocity in response to said reduce velocity control signal.

13. The method of claim 12, the registration velocity adjustment further comprises reducing the registration velocity by about 2-3% in response to said reduce velocity control signal.

14. The method of claim 9, the substantially uniform contact provided between said print substrate and said image-retentive member using a transfer assist member further comprises:

pressing at least one blade portion against the print substrate in a direction toward said photoreceptive member, each blade portion pressed against the print substrate including a contact surface, a leading edge and a trailing edge, said contact surface comprising a convex middle portion relative to said leading and trailing edges of said contract surface, and said convex middle portion extending approximately across a width of said contact surface in a cross-process direction.

15. The method of claim 14, said contact surface being essentially convex from said leading edge to said trailing edge.

16. The method of claim 9, further comprising:

allowing a user to select the registration velocity; and generating a velocity control signal that corresponds to a selection made by the user.

17. An electrostatographic machine comprising:

an image-retentive member moving at a preselected velocity in a process direction;

a transfer station for transferring toner to a print substrate, the transfer station including a transfer assist member for providing substantially uniform contact between said print substrate and said image-retentive member;

a registration controller for driving said print substrate and feeding said print substrate to said transfer station at a registration velocity; and a system controller operably associated with said registration controller, said system controller for monitoring at least one operating parameter of an electrostatographic machine and generating a control signal in response to the at least one operating parameter;

the registration controller being responsive to said control signal and configured to adjust the registration velocity in accordance with said control signal as the image-retentive member is moving at the preselected velocity.

18. The electrostatographic machine of claim 17, said at least one operating parameter monitored by the system controller comprises print substrate type; and said system controller is operable to generate a reduce velocity control in response to said print substrate type being lightweight media.

19. The electrostatographic machine of claim 18, the registration controller being operable to reduce the registration velocity of said print substrate by about 2-3% relative to said preselected velocity of said image-retentive member.

20. The electrostatographic machine of claim 19, said transfer assist member includes at least one blade portion for applying pressure against the print substrate in a direction toward said photoreceptive member, each blade portion including a contact surface, a leading edge and a trailing edge, said contact surface comprising a convex middle portion relative to said leading and trailing edges of said contract surface, and said convex middle portion extending approximately across a width of said contact surface in a cross-process direction.

* * * * *